US012279697B2

(12) United States Patent
Bellingroth et al.

(10) Patent No.: US 12,279,697 B2
(45) Date of Patent: Apr. 22, 2025

(54) BED WITH MULTIPLE SEPARABLE SEGMENTS

(71) Applicant: TFC TECHNOLOGY CO., LTD, Jiaxing (CN)

(72) Inventors: Klaus Bellingroth, Gummersbach (DE); Peng Liu, Zhejiang (CN); Wenxia Peng, Zhejiang (CN)

(73) Assignee: TFC TECHNOLOGY CO., LTD, Jiaxing (CN)

( * ) Notice: Subject to any disclaimer, the term of this patent is extended or adjusted under 35 U.S.C. 154(b) by 784 days.

(21) Appl. No.: 17/511,541

(22) Filed: Oct. 26, 2021

(65) Prior Publication Data

US 2022/0133048 A1 May 5, 2022

Related U.S. Application Data

(63) Continuation-in-part of application No. 17/102,330, filed on Nov. 23, 2020, now abandoned.

(30) Foreign Application Priority Data

Oct. 30, 2020 (CN) ..... 202011196344.6
Aug. 31, 2021 (CN) ..... 202122103669.1

(51) Int. Cl.

| | |
|---|---|
| ***A47C 19/00*** | (2006.01) |
| ***A47C 19/12*** | (2006.01) |
| ***A47C 20/02*** | (2006.01) |
| ***A47C 20/04*** | (2006.01) |

(52) U.S. Cl.
CPC ..... *A47C 19/005* (2013.01); *A47C 19/12* (2013.01); *A47C 20/021* (2013.01); *A47C 20/027* (2013.01); *A47C 20/041* (2013.01)

(58) Field of Classification Search
CPC ..... A47C 19/005; A47C 19/12; A47C 20/021; A47C 20/027; A47C 20/041
USPC ..... 5/132
See application file for complete search history.

(56) References Cited

U.S. PATENT DOCUMENTS

| | | | | |
|---|---|---|---|---|
| 2,374,488 A * | 4/1945 | Knox | ..... | A61G 13/00 5/21 |
| 3,743,351 A * | 7/1973 | Harris | ..... | A47C 13/00 297/118 |
| 4,970,737 A * | 11/1990 | Sagel | ..... | A47C 20/08 5/616 |

(Continued)

*Primary Examiner* — David R Hare
*Assistant Examiner* — Luke Hall
(74) *Attorney, Agent, or Firm* — Andrew C. Cheng

(57) ABSTRACT

A bed with multiple separable segments includes a first bed body segment including a first platform part and a first support frame; a second bed body segment including a second platform part and a second support frame; and a third bed body segment connected to the first and second bed body segments and including a third platform part and a third support frame. The first, second and third platform parts together form a platform for bearing loads and are arranged sequentially in a longitudinal direction of the platform. The first and second support frames are detachably connected with the third support frame via fasteners. The bed with multiple separable segments of the present disclosure may be separated into multiple bed body segments to be stacked together so as to facilitate storage or transportation.

19 Claims, 6 Drawing Sheets

(56) References Cited

U.S. PATENT DOCUMENTS 5,095,562 A * 3/1992 Alexander ..... A47C 20/041 5/619
5,438,723 A * 8/1995 Carroll ..... A61G 7/002 5/618
6,357,065 B1 * 3/2002 Adams ..... A61G 7/005 5/617
6,516,479 B1 * 2/2003 Barbour ..... A61G 7/015 5/152
6,948,688 B1 * 9/2005 Payne ..... A47C 19/024 5/509.1
6,990,698 B2 * 1/2006 Wall, Sr. ..... A47C 20/041 5/618
7,207,622 B2 * 4/2007 Cohan ..... A47C 1/143 5/112
7,237,288 B2 * 7/2007 Lemire ..... A61G 7/052 5/617
7,487,559 B1 * 2/2009 Denosky ..... A61G 7/1025 5/81.1 HS
7,676,861 B2 * 3/2010 Ward ..... A61G 1/0262 5/430
7,779,494 B2 * 8/2010 Poulos ..... A61G 7/16 5/618
7,886,380 B2 * 2/2011 Hornbach ..... A47C 19/045 5/613
8,418,291 B2 * 4/2013 Hornbach ..... A61G 7/0514 5/616
9,572,735 B2 * 2/2017 Johnson ..... A61G 7/012
9,668,587 B1 * 6/2017 Huang ..... A47C 19/005
9,713,388 B2 * 7/2017 Goldsmith ..... A47C 20/041
9,750,661 B2 * 9/2017 Lurie ..... A61H 31/006
9,994,072 B2 * 6/2018 Lyon ..... B60B 33/0092
10,219,958 B2 * 3/2019 Johnson ..... A61G 7/012
2009/0113626 A1 * 5/2009 Harrow ..... A47C 19/005 5/132
2009/0293197 A1 * 12/2009 Larson ..... A61G 7/002 5/613
2010/0229303 A1 * 9/2010 Goldsmith ..... A47C 19/005 5/285
2014/0325759 A1 * 11/2014 Bly ..... A61G 7/015 5/613
2015/0250323 A1 * 9/2015 Goldsmith ..... A47C 19/12 5/11

* cited by examiner

BED WITH MULTIPLE SEPARABLE SEGMENTS

FIELD

The present disclosure relates to an electric bed, in particular to a bed with multiple separable segments.

BACKGROUND

With the improvement of living standards, people in today's society pay more and more attention to their quality of life, and in addition to the requirement on softness and comfort during sleep, people have more and more strict requirement on healthy sleep and also present some requirements on functions for activities. People need adjustable electric beds that can provide free angle adjustments of bed head and feet to improve sleep comfort. For example, when people are, in bed, watching TV, reading books, reading newspapers, or taking a rest or adjusting posture for promoting blood circulation, they need to raise their back or knees at a certain angle, so as to be in a half-lying and half-sitting posture that is comfortable.

Currently, commercially available electric beds are almost non-foldable beds or bi-fold beds. The bi-fold bed is designed as having two parts that can be folded together. Although, compared to the non-foldable bed, the volume of the bi-fold bed has been reduced to a large extent after the two parts of the bed are folded together, the volume of the bi-fold bed is still relatively large, and thus the transportation and storage costs are still relatively high. For electric beds of commonly used sizes, the bi-fold beds are not suitable to be transported by a family car since it cannot be directly loaded in a trunk of the car.

SUMMARY

In view of this, the present disclosure provides a bed with multiple separable segments which has a reduced packaging volume to facilitate transportation and storage.

In one aspect, the present disclosure provides a bed with multiple separable segments. The bed comprises a first bed body segment comprising a first platform part and a first support frame installed on a bottom side of the first platform part; a second bed body segment comprising a second platform part and a second support frame installed on a bottom side of the second platform part; and a third bed body segment connected to the first bed body segment and the second bed body segment respectively, the third bed body segment comprising a third platform part and a third support frame installed on a bottom side of the third platform part. The first platform part, the second platform part and the third platform part cooperatively form a platform of the bed for bearing loads, the platform defines a longitudinal direction and a transverse direction perpendicular to each other, the first platform part, the third platform part and the second platform part are arranged sequentially in the longitudinal direction, and each of the first support frame and the second support frame is connected with the third support frame in an insertion connection manner and detachably fastened with the third support frame via fasteners.

In summary, the present disclosure provides a bed with multiple separable segments, which can be detached/separated into multiple bed body segments that are connected together in an insertion connection manner to form a complete bed, wherein the platform of the bed is divided into multiple parts, and the support assembly of the bed is divided into three parts that are connected to each other in the insertion connection manner, such that the parts of the platform and the parts of the support assembly can be combined to form a bed body, thereby greatly reducing stacking dimension and package volume to facilitate storage or transportation. Thus, after such a bed of the conventional size is detached, its size is suitable to be directly placed in a family car to provide convenience for customers to purchase, transport and move. The longitudinal beam of the third support frame in the support assembly plays the role of mandrel connection, its two ends are respectively plugged or inserted into the cavities of the first support frame and the second support frame located at the front end and back end respectively, such that multiple bed body segments are integrated, which provides a simple and quick combination. The actuators of the bed are fixed to the support frames of the backrest portion and the leg support portion respectively, and thus it is unnecessary to perform an installation operation for them, which reduces assembly difficulty for customer.

Figure 1:
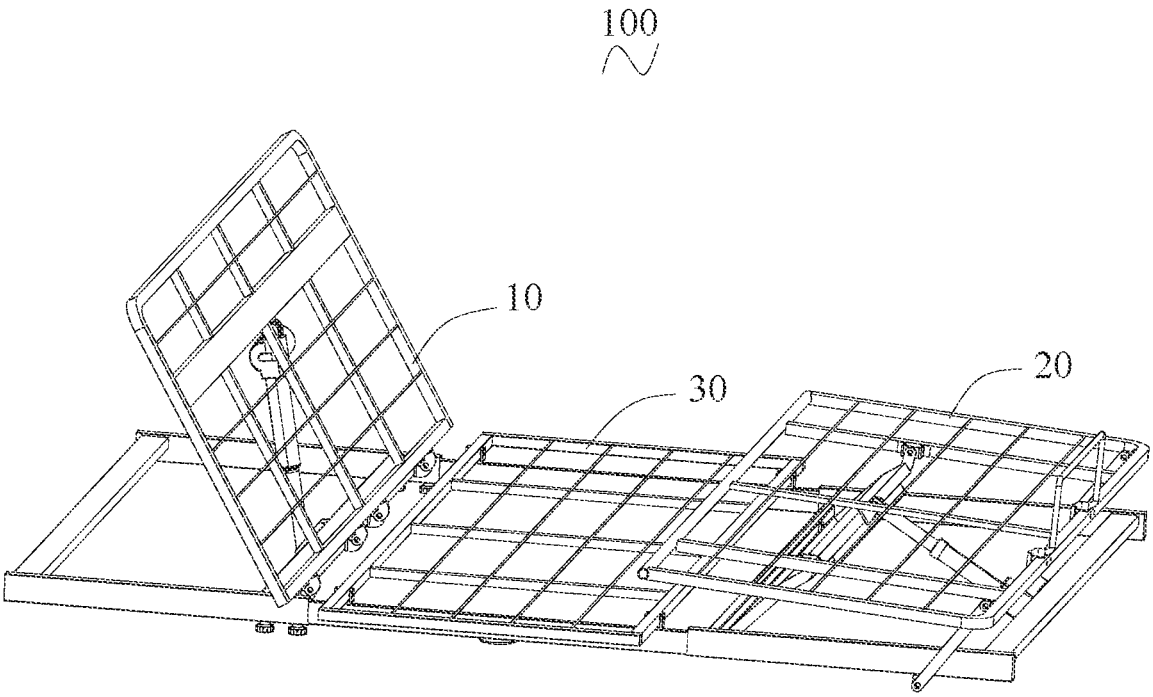
FIG. 1 is a perspective view of an assembled bed with multiple separable segments of the present disclosure, the first platform part and the second platform part being lifted up.
Figure 2:
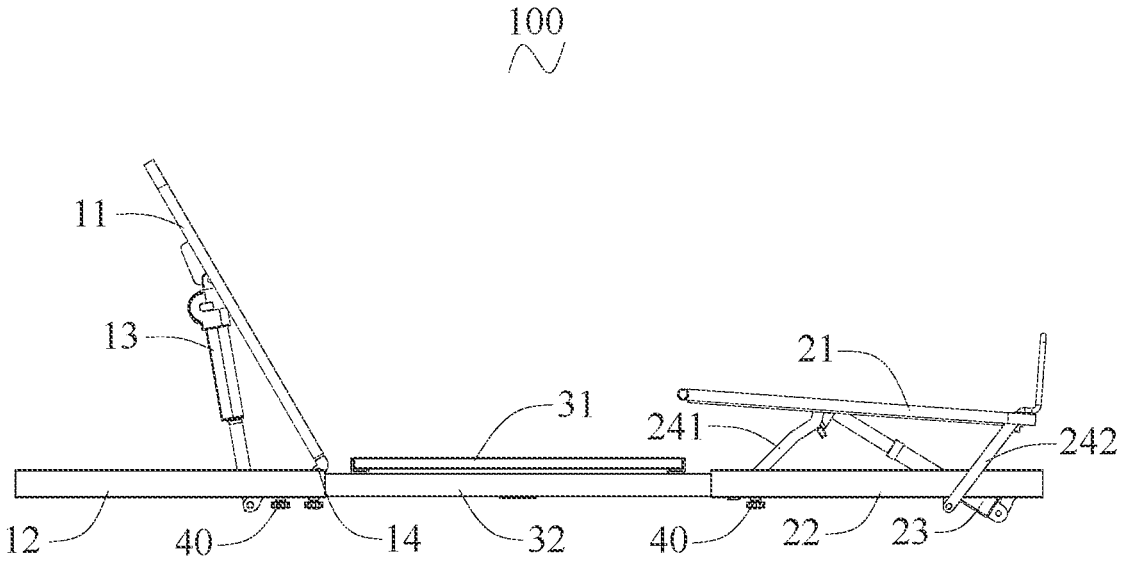
FIG. 2 is a side view of the bed of FIG. 1.
Figure 3:
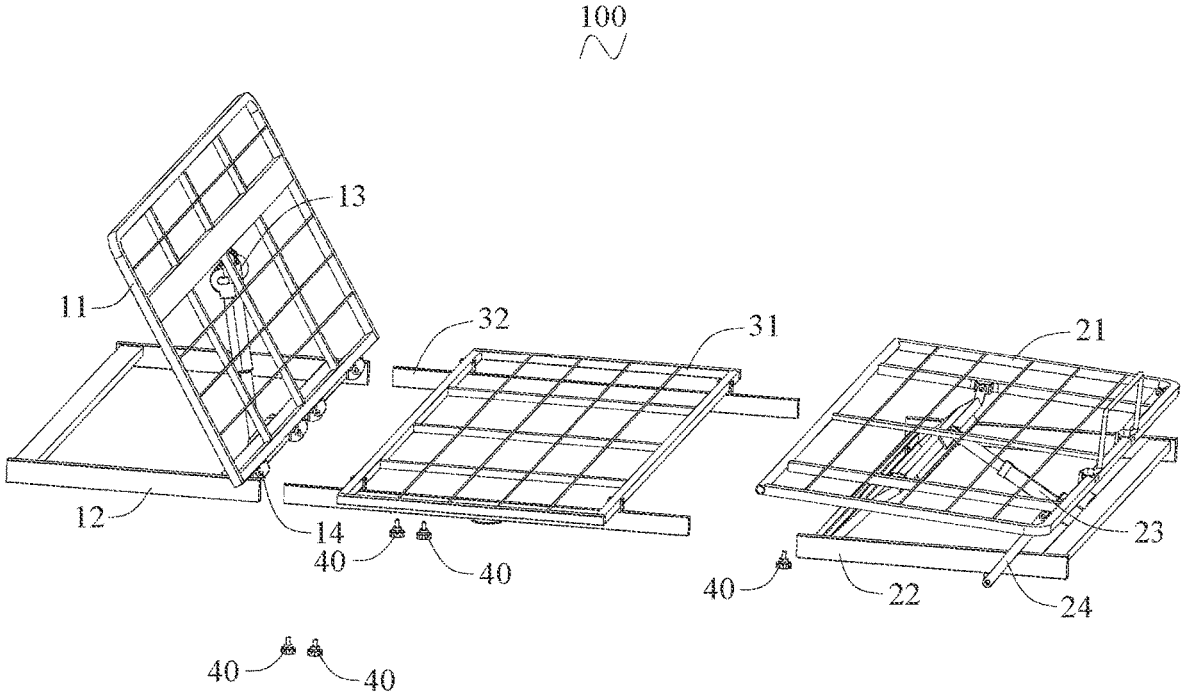
FIG. 3 is an exploded view of the bed of FIG. 1.
Figure 4:
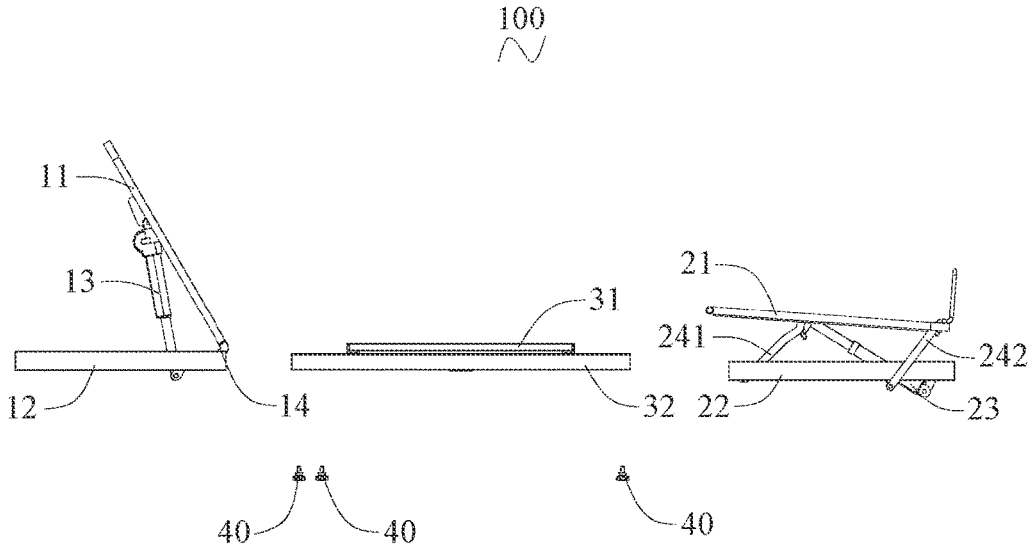
FIG. 4 is a side view of the bed of FIG. 3.

REFERENCE SIGNS IN THE FIGURES ARE AS FOLLOWS first bed body segment 10 (wherein: first platform part 11, first support frame 12, first actuator 13, first hinge 14; first U-shaped frame 111, first transverse connection rod 112, first transverse reinforcing member 113, first longitudinal rod 114, first transverse connection ribs 115, first upper hinge tab 1121; first longitudinal beam 121, first transverse beam 122; first hinge seat 1131; first connection end 1211, first locking hole 1211*a*); second hinge seat 1221, reinforcing rib 1222, first lower hinge tab 1223);

second bed body segment 20 (wherein: second platform part 21, second support frame 22, second actuator 23, second transmission mechanism 24, second U-shaped frame 211, second transverse connection rod 212, stop member 213, second longitudinal rod 214, second transverse connection rib 215; second longitudinal beam 221, second transverse beam 222; second connection end 2211; second locking hole 2211*a*; third hinge seat 2221; first connection rod 241, second connection rod 242, first transverse connection rod 243, second transverse connection rod 244);

third bed body segment 30 (wherein; third platform part 3L third support frame 32; third longitudinal rod 311, third transverse rod 312, fourth longitudinal rod 313; third transverse connection rib 314; third longitudinal beam 321; third connection end 3211, fourth connection end 3212, third locking hole 3211*a*, fourth locking hole 3212*a*).

fastener 40.

DESCRIPTION OF THE EMBODIMENTS

Before describing embodiments in detail, it should be understood that the present disclosure is not limited to the detailed structure or arrangement of elements described below or illustrated in the drawings in the present disclosure. The present disclosure may be embodiments implemented in other ways. Moreover, it should be understood that terms and wordings used herein are only for descriptive purposes and should not be interpreted in a limited manner. The wordings "include", "comprise", "have" and the like used herein mean to include items listed thereafter, their equivalents and other additional items. In particular, when describing "a/an" element, the present disclosure does not intend to limit the number of the element to one, but may include multiple elements.

The disclosure provides a bed detachably assembled by multiple bed body segments which are configured to be connected to each other to form a complete bed together. For storage and/or transportation purposes, the bed body segments can be separated from each other and then stacked together to thereby reduce packaging volume of the bed. Embodiments of the present disclosure will be described in details by taking a bed with three bed body segments as an example. It should be understood that the bed of the present disclosure may also have more than three bed body segments.

Referring to FIGS. 1 to 4, the present disclosure provides a bed which, after be disassembled, has a greatly reduced packaging volume compared with conventional electric beds, and thus has a size convenient for transportation and storage. The bed includes a platform and a support assembly for supporting the platform. The bed and its platform define a longitudinal direction and a transverse direction perpendicular to the longitudinal direction. The platform is configured to support a load, such as a human body. Usually, a mattress is placed on the platform during use. Further, the bed may also include a plurality of support legs (not shown) that are installed to the support assembly.

In the illustrated embodiment, the bed includes a first bed body segment 10, a second bed body segment 20 and a third bed body segment 30. In an embodiment shown in FIGS. 1 to 4, the first bed body segment 10, the third bed body segment 30 and the second bed body segment 20 are arranged sequentially in the longitudinal direction, and are detachably connected to each other.

The first bed body segment 10 includes a first platform part 11 and a first support frame 12 installed on a bottom side of the first platform part 11. The second bed body segment 20 includes a second platform part 21 and a second support frame 22 installed on a bottom side of the second platform part 21. The third bed body segment 30 includes a third platform part 31 and a third support frame 32 installed on a bottom side of the third platform part 31. In the illustrated embodiment, the first platform part 11, the second platform part 21 and the third platform part 31 together form the platform of the bed. The first support frame 12, the second support frame 22 and the third support frame 32 together form the support assembly of the bed. In other words, the bed may be divided into three bed body segments, for example, the first bed body segment 10, the second bed body segment 20 and the third bed body segment 30.

The first bed body segment 10 including the first platform part 11 and the first support frame 12, may further include a number of support legs installed to the first support frame 12. The second bed body segment 20 including the second platform part 21 and the second support frame 22, may further include a number of support legs installed to the second support frame 22. The third bed body segment 30 including the third platform part 31 and the third support frame 32 may also include a number of support legs installed to the third support frame 32. These support legs are used as a supporting structure to support the platform at a predetermined distance from the ground. It can be understood that, in other embodiments, the support structure may also be implemented in other forms, such as a support frame with a height adjustment function (for example, a scissor or cross brace).

The first bed body segment 10 comprises a first actuator 13, the second bed body segment 20 comprises a second actuator 23. The first actuator 13 is connected between the first platform part 11 and the first support frame 12 and configured to drive the first platform part 11 to move relative to the first support frame 12. The second actuator 23 is connected between the second platform part 21 and the second support frame 22 and configured to drive the second platform part 21 to move relative to the second support frame 22. The first platform part 11 is pivotably connected to the first support frame 12 via a pivoting connection structure such as a hinge 14. The second platform part 21 is attached to the first support frame 22 via a second transmission mechanism 24. The third platform part 31 is fixed on the third support frame 32. In the illustrated embodiment, the first actuator 13 and the second actuator 23 is offset in the longitudinal direction, i.e., the first actuator 13 and the second actuator 23 are not aligned with each other in the longitudinal direction, to avoid interference between the first actuator 13 and the second actuator 23 when the first bed body segment 10 and the second bed body segment 20 are stacked one above the other.

In the illustrated embodiment, the first platform part 11, the second platform part 21 and the third platform part 31 are not connected directly. The first support frame 12 and the second support frame 22 are connected to the third support frame 32 via insertion connections and are detachably fastened/fixed together via fasteners 40. Insertion connections are formed between the rear end of the first support frame 12 and the front end of the third support frame 32, and the front end of the second support frame 22 and the rear end of the third support frame 32 respectively. In some embodiments, the first platform part 11 of the first bed body segment 10 is a headrest and backrest portion, the second platform part 21 of the second bed body segment 20 is a leg and foot support portion, and the third platform part 31 of the third bed body segment 30 is a buttocks support portion. The first bed body segment 10, the second bed body segment 20 and the third bed body segment 30 are combined into a complete bed, which may also be detached into three independent segments. In a combined/assembled state, the first platform part 11, the third platform part 31 and the second platform part 21 are connected sequentially in the longitudinal direction to form the platform for supporting loads. In a detached state, the first bed body segment 10, the second bed body segment 20 and the third bed body segment 30 may be stacked one on top of another, such that the stack has a length slightly greater than one third of an overall longitudinal length of the bed and a thickness less than three times a thickness of the bed.

The first platform part 11 is pivotably connected to the first support frame 12 via the first actuator 13 and the first hinges 14. Specifically, the rear end of the first platform part 11 is hinged to the first support frame 12 by the first hinges 14, so that the first platform part 11 can rotate about the first hinges 14 relative to the first support portion 12. The first actuator 13 is connected to the first platform part 11 and the first support frame 12 respectively, so that the first actuator 13 is capable of driving the first platform part 11 to rotate relative to the first support portion 14.

Figure 5:
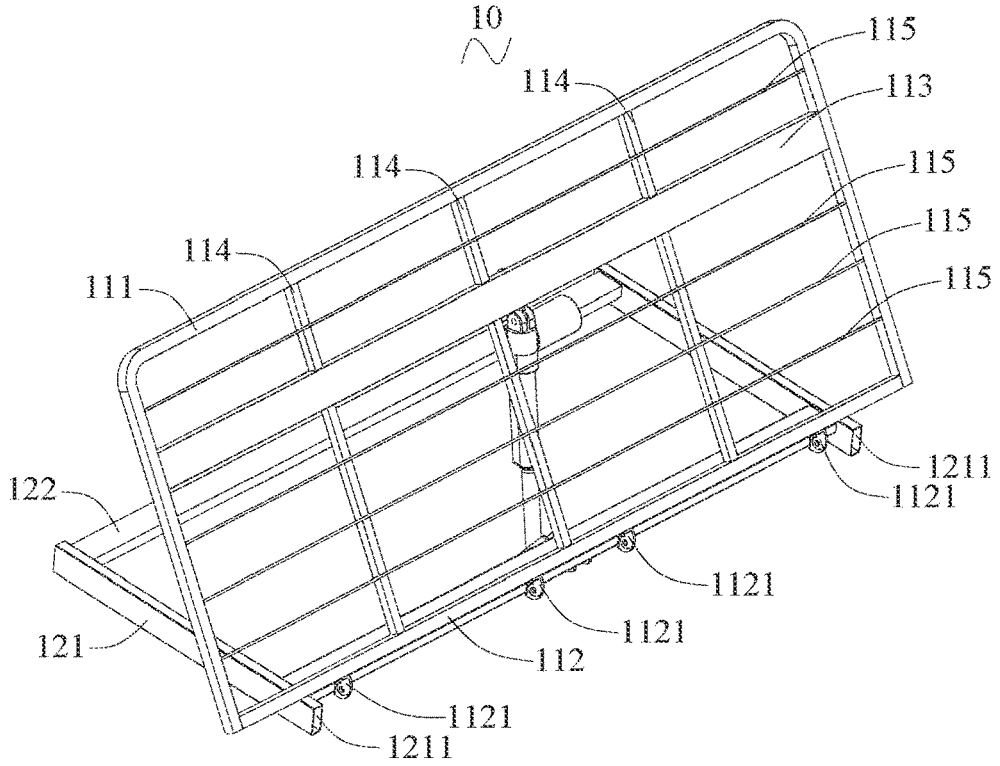
FIG. 5 is an enlarged view of the first bed body segment of the bed in FIG. 1.
Figure 6:
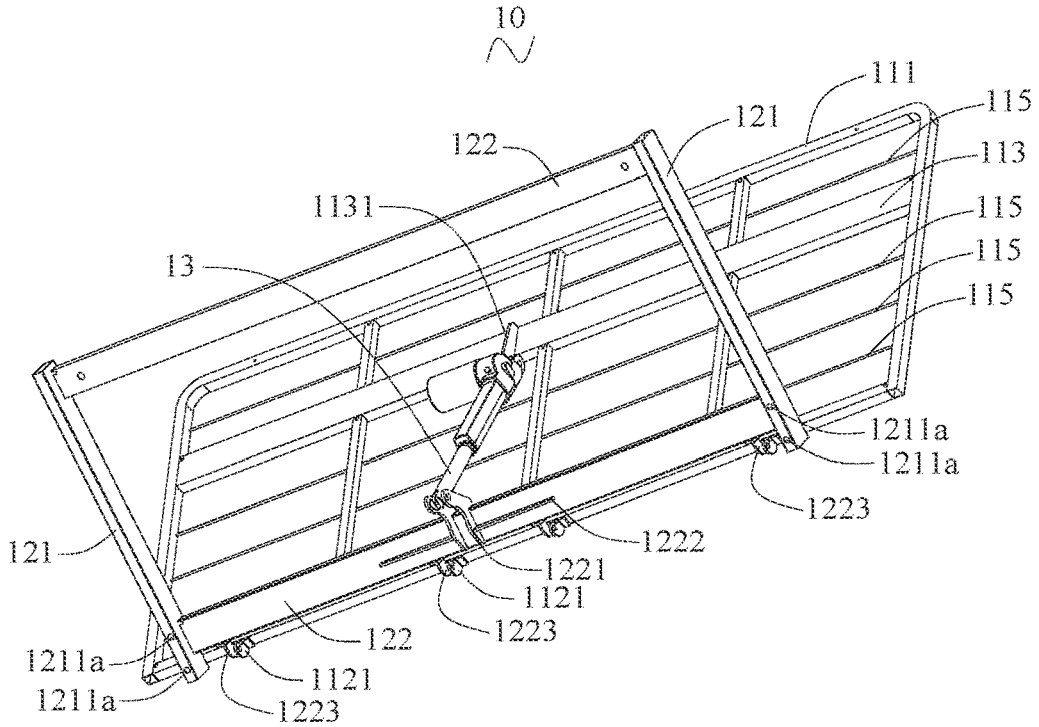
FIG. 6 is similar to FIG. 5, but viewed from another aspect.

As shown in FIG. 5 and FIG. 6, the first platform part 11 has a complete/entire/whole structure which does not need to be assembled during use. The first platform part 11 includes a U-shaped frame 111, a first transverse connection rod 112, a first transverse reinforcing member 113, first longitudinal rods 114 and first transverse connection ribs 115. The first U-shaped frame 111 has a U-shaped configuration which comprises two sides sections arranged in parallel along the longitudinal direction to form longitudinal sections, and a middle/connection section arranged in the transverse direction to form a transverse section connected between the longitudinal sections. The first transverse connection rod 112 is arranged in the transverse direction and both ends thereof are connected to ends of the longitudinal sections of the first U-shaped frame 111 away from the transverse section. That is, the first transverse connection rod 112 closes the open end of the U-shaped configuration. The first transverse connection rod 112 and the first U-shaped frame 111 together form the outer profile of the first platform part 11. The first transverse reinforcing member 113 is a reinforcing rod or plate arranged transversely parallel to the first transverse connection rod 112, its two ends are connected to the longitudinal sections of the first U-shaped frame 111, and the first transverse reinforcing member 113 is arranged close to the transverse section of the first U-shaped frame 111. The longitudinal width of the first transverse reinforcing member 113 is greater than the longitudinal width of the transverse section of the first U-shaped frame 111 and the longitudinal width of the first transverse connection rod 112 to strengthen the structure of the first platform part 11. A plurality of first longitudinal rods 114 are arranged in parallel along the longitudinal direction and spaced from each other in the transverse direction. Each first longitudinal rod 114 passes through the first transverse reinforcing member 113 and the two ends thereof are connected to the first transverse connection rod 112 and the transverse section of the first U-shaped frame 111. The structure of the first platform part 11 is strengthened. A plurality of first transverse connection ribs 115 are parallel to the first transverse connection rod 112, and the first transverse reinforcing member 113 is arranged transversely above the first longitudinal rod 114, and the two ends of the first transverse reinforcing member 113 are connected to the longitudinal sections of the first U-shaped frame 111.

In the illustrated embodiment, the first support frame 12 includes two spaced and parallel first longitudinal beams 121 and a plurality of first transverse beams 122 connected between the two first longitudinal beams 121. The two first longitudinal beams 121 extend along the longitudinal direction of the bed and are arranged at intervals along the transverse direction of the bed. The rear ends of the first longitudinal beams 121 act as first connection ends 1211 for connecting with the third bed body segment 30. First locking holes 1211*a* are defined in the lower end surface of the first connection ends 1211 for installing the fasteners 40.

In the illustrated embodiment, the first actuator 13 is of an electric push rod, and its two ends are respectively connected to the first transverse reinforcing member 113 and the first transverse beam 122 at the rear end of the first support frame 12. Specifically, a first hinge seat 1131 is provided on the lower end surface of the first transverse reinforcement beam 113 and hinged to one end of the first actuator 13. A second hinge seat 1221 is provided on the first transverse beam 122 at the rear end of the first support frame 12 and hinged to the other end of the actuator 13. In order to increase the strength of the second hinge seat 1221, a reinforcing rib 1222 is provided on each of opposite sides of the second hinge seat 1221, and the reinforcing ribs 1222 are vertically connected between the second hinge seat 1221 and the lower end surface of the first transverse beam 122 at the rear end of the first support frame 12.

The first transverse connection rod 112 is hinged to the first transverse beam 122 at the rear end of the first support frame 12 through a plurality of first hinges 14. The hinge axis of the first hinge 14 is arranged in the transverse direction, so that the first platform part 11 can be lifted up relative to the first support frame 12 via rotating about the hinge axis of the first hinges 14 in the transverse direction. Specifically, a plurality of first upper hinge tabs 1121 are provided on the first transverse connection rod 112, and a plurality of first lower hinge tabs 1223 are correspondingly provided on the first transverse beam 122 at the rear end of the first support frame 12. The first upper hinge tabs 1121 and the corresponding first lower hinge tabs 1223 are rotatably connected by hinges or shafts so that the first platform part 11 is hinged to the first support frame 12.

The second platform part 21 and the second support frame 22 are connected by a second actuator 23 and the second transmission mechanism 24. Specifically, the second platform part 21 and the second support frame 22 are connected by a first connection rod 241 and a second connection rod 242 which are pivotably connected between the second platform part 21 and the second support frame 22, so that the second platform part 21 can be lifted up or lowered relative to the second support frame 22. The second actuator 23 is connected to the second platform part 21 and the second support frame 22 respectively, so that the second actuator 23 is capable of driving the second platform part 21 to move with respect to the second support frame 22.

Figure 7:
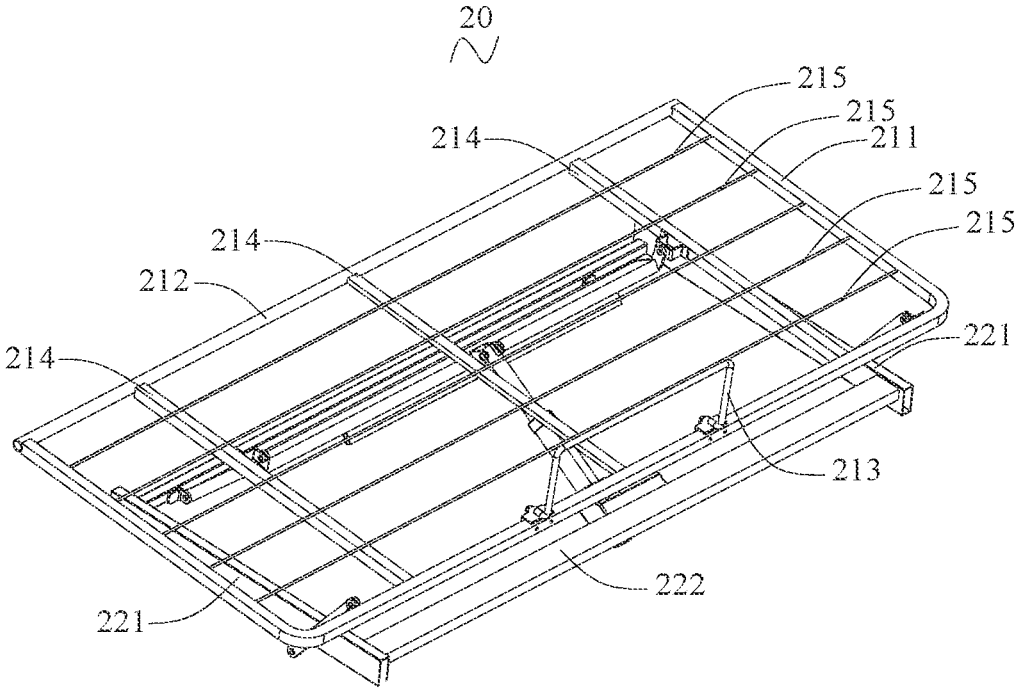
FIG. 7 is an enlarged view of the second bed body segment of the bed in FIG. 1.
Figure 8:
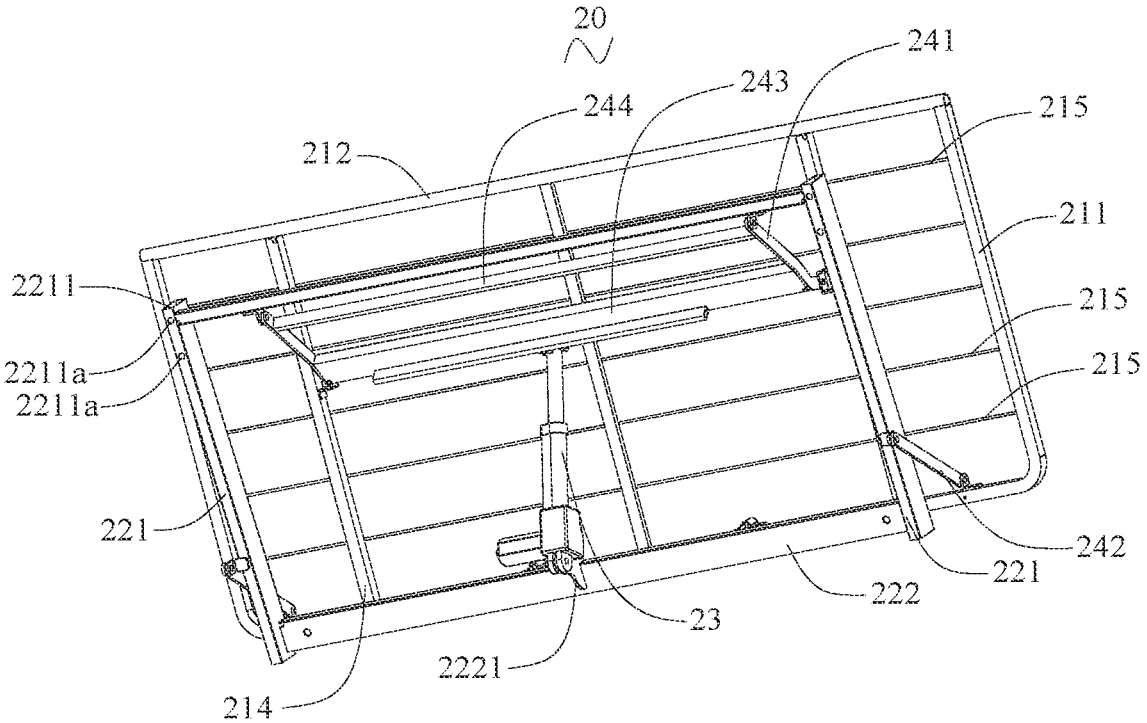
FIG. 8 is another perspective view of the second bed body segment in FIG. 7.

Referring to FIGS. 7 and 8, the second platform part 21 has a complete/entire/whole structure which does not need to be assembled during use. The second platform part 21 includes a second U-shaped frame 211 which is preferably integrally formed, a second transverse connection rod 212, a stop member 213, second longitudinal rods 214 and second transverse connection ribs 215. The second U-shaped frame 211 has U-shaped configuration with two side sections arranged in parallel in the longitudinal direction to form longitudinal sections and a middle section arranged in the transverse direction to form a transverse section. The second transverse connection rod 212 is arranged in the transverse direction and its two ends are connected to ends of the longitudinal sections of the second U-shaped frame 211. Thus, the second transverse connection rod 212 closes the open end of the second U-shaped frame 211. The second transverse connection rod 212 and the second U-shaped frame 211 together form the outer profile of the second platform part 21. The stop member 213 is vertically arranged on the transverse section of the second U-shaped frame 211 with the lower ends thereof being connected to the transverse section of the second U-shaped frame 211 and the upper part extending upward in the vertical direction. The stop member 213 is configured to stop/abut the end of the mattress put on the second platform part 21. A plurality of parallel and spaced second longitudinal rods 214 extend along the longitudinal direction. Opposite two ends of each second longitudinal rod 214 are connected to the second transverse connection rod 212 and the transverse section of the second U-shaped frame 211 to strengthen the structure of the second platform 21. A plurality of second transverse connection ribs 215, in parallel to the second transverse connection rod 212, are transversely arranged above the second longitudinal rods 214, and two ends of each of the second transverse connection ribs 215 are connected to the longitudinal sections of the second Li-shaped frame 211.

In the illustrated embodiment, the second supporting frame 22 includes two spaced apart and parallel second longitudinal beams 221 and a plurality of second transverse beams 222 connected between the two second longitudinal beams 221. The two second longitudinal beams 221 extend along the longitudinal direction of the bed and are arranged at intervals along the transverse direction of the bed. The front end of the second longitudinal beam 221 acts as a second connection end 2211 for connecting with the third bed body segment 30. Second locking holes 2211*a* are defined in the lower end surface of the second connection end 2211 for installing of the fastener 40.

The second transmission mechanism 24 includes a first connection rod 241 and a second connection rod 242. Two ends of each of the first connecting frame rod 241 and the second connecting frame rod 242 are respectively connected to the second platform part 21 and the second support frame 22. The second support frame 22, the first connection rods 241, the second platform part 21, and the second connection rod 242 are hinged to each other in sequence to form a four-bar linkage. The second support frame 22 act as the base/ground/fixed link of the four-bar linkage, the second platform part 21 acts as a side link/rocker of the four-bar linkage, the second connection rod 242 both ends of which are hinged to the second support frame 22 and the second platform part 21 acts as another side link/rocker of the four-bar linkage, and the second platform part 21 acts as a floating link/connecting bar/coupler of the four-bar linkage. Specifically, the two ends of the first connection rod 241 are hinged to the second longitudinal rod 214 and the second transverse beam 221 close to the third bed body segment 30 respectively, and the two ends of the second connection rod 242 are respectively hinged to the transverse section of the second U-shaped frame 211 and the second longitudinal beam 221. Preferably the second transmission mechanism 24 includes a pair of spaced first connection rods 241 and a pair of spaced second connection rods 242. In order to enhance the structural strength, a first transverse connection rod 243 and a second transverse connection rod 244 are arranged between the two parallel first connection rods 241. The first transverse connection rod 243, the second transverse connection rod 244 and the two first connection rods 241 cooperatively form a rectangular structure with increased structural strength.

In the illustrated embodiment, the second actuator 23 is an electric push rod the two ends of which are respectively connected to the first transverse connection rod 243 and the second transverse beam 222 at the rear end of the second support frame 22. Specifically, a hinge seat (not labelled) is provided on the first transverse connection rod 243 and hinged to one end of the second actuator 23. The second transverse beam 222 is provided with a third hinge seat 2221, to which the other end of the second actuator 23 is hinged.

Figure 9:
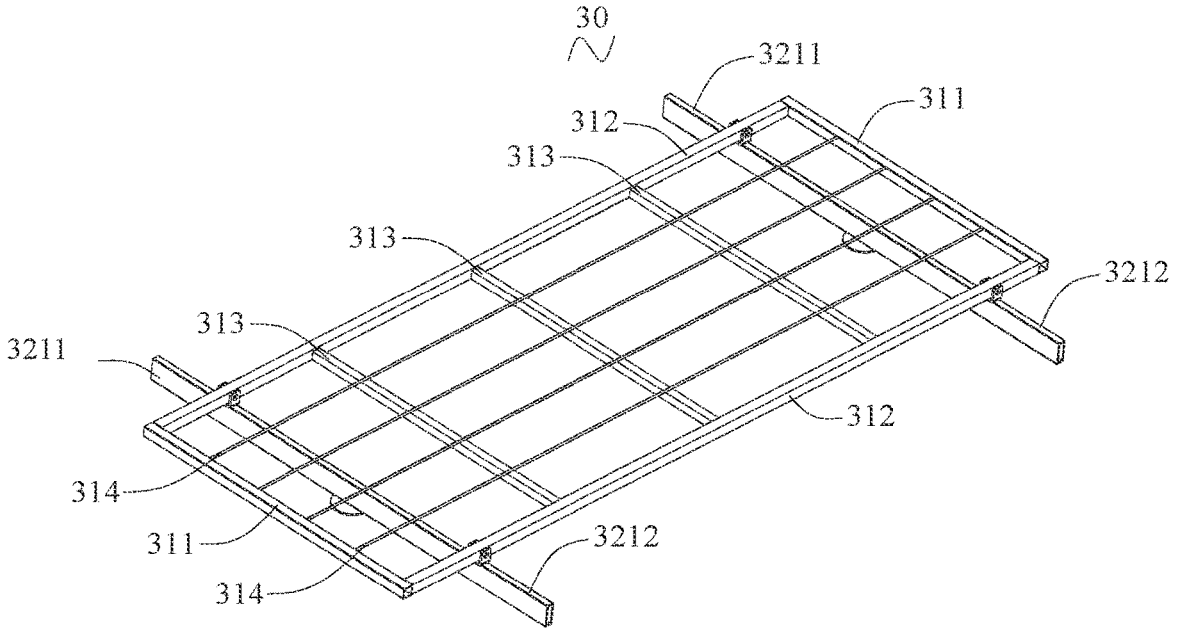
FIG. 9 is an enlarged view of a third bed body segment of the bed in FIG. 1.
Figure 10:
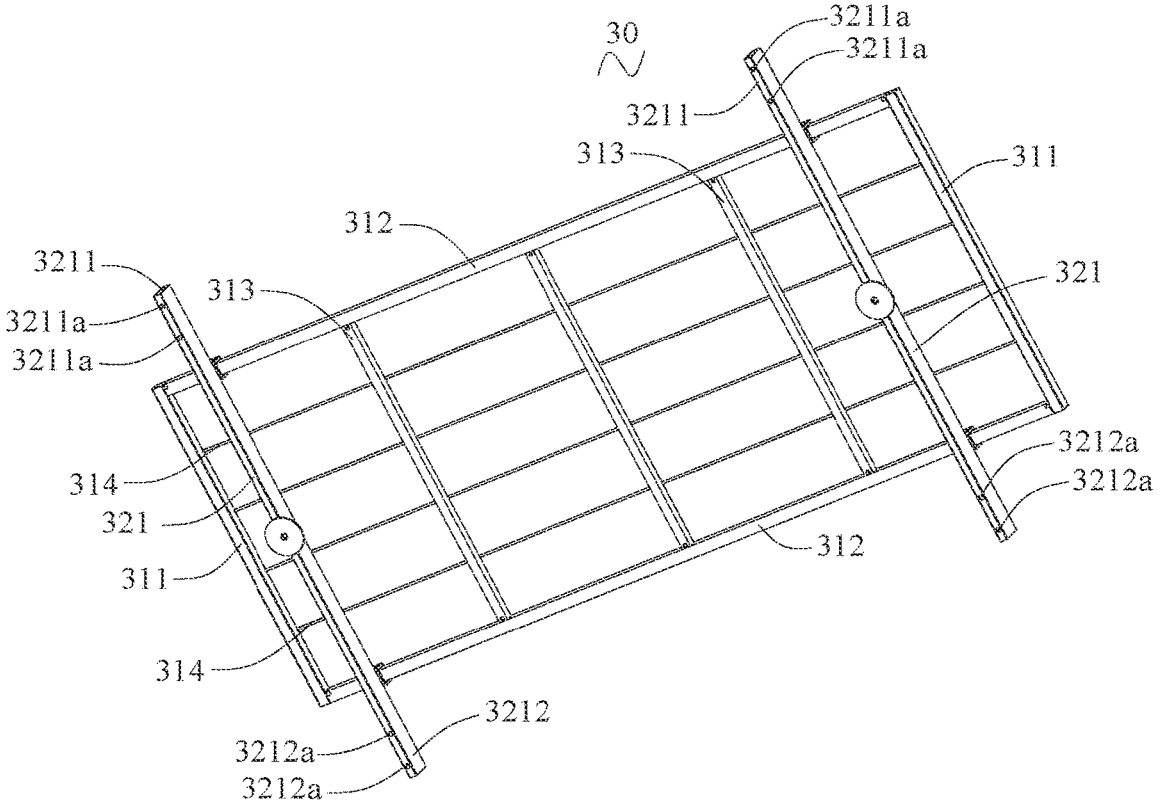
FIG. 10 is another perspective view of the third bed body segment in FIG. 9.

Referring to FIG. 9 and FIG. 10, the third platform part 31 has a complete/entire/whole structure which includes two third longitudinal rods 311, third transverse rods 312, fourth longitudinal rods 313 and third transverse connection ribs 314. The two third longitudinal rods 311 are arranged in parallel along the longitudinal direction, and the two third transverse rods 312 are respectively transversely connected to the ends of the two third longitudinal rods 311. A plurality of fourth longitudinal rods 313 are arranged in parallel between the two third longitudinal rods 311 and spaced apart from each other, and two ends of each fourth longitudinal rod 313 are respectively connected to two third transverse rods 312. A plurality of third transverse connection ribs 314 are transversely arranged on the fourth longitudinal rod 313 and parallel to the third transverse rod 312, and two ends of the third transverse connection ribs 314 are connected to the third longitudinal rods 311 located on opposite sides of the third platform part 31.

In the illustrated embodiment, the third support frame 32 includes two spaced and parallel third longitudinal beams 321 which extend along the longitudinal direction of the bed and are arranged at intervals along the transverse direction of the bed. The longitudinal ends of the third longitudinal beams 321 act as respectively the third connection ends 3211 and the fourth connection ends 3212. The third connection end 3211 is provided with third locking holes 3211*a* for connecting with the first support frame 11 of the first bed body segment 10. The fourth connection ends 3212 are provided with fourth locking holes 3212*a* for connecting with the second support frame 21 of the second bed body segment 20. Each third longitudinal beam 321 is fixedly connected with the two third transverse rods 312, so that the third bed body 30 forms an integral and fixed structure.

In the illustrated embodiment, the lateral distance between the two first longitudinal beams 121 and the lateral distance between the two second longitudinal beams 221 are matched with the lateral distance between the two third longitudinal beams 321, so that when the first bed body part 10 and the second bed body part 20 are inserted to the third bed body part 30 from both ends of the third bed body part 30, the first support frame 12 and the second support frame 22 are respectively aligned with the third support frame 32, so that the first longitudinal beams 121 of the first support frame 12 and the second longitudinal beams 221 of the second support frame 22 can be connected with the corresponding third longitudinal beam 321 of the third support frame 32 via insertion connection manners, respectively. In other embodiments, the first support frame 12 may include more than two first longitudinal beams 121, and the second support frame 22 may include more than two second longitudinal beams 221. Correspondingly, the third support frame 32 may include more than two third longitudinal beams 321.

The first connection ends 1211 and the corresponding third connection ends 3211 are connected in an insertion connection manner in the longitudinal direction, and the second connection ends 2211 and the corresponding fourth connection ends 3212 are connected in an insertion connection manner in the longitudinal direction. The first connection end 1211 of each first longitudinal beam 121, the second connection end 2211 of each second longitudinal beam 221 and the third and fourth connection ends 3211, 3212 of the corresponding third longitudinal beam 321 are aligned with each other in the longitudinal direction, that is, there is no offset in the longitudinal direction. Specifically, the first and second connection ends define first and second inner cavities, the third connection end 3211 of each third longitudinal beam 321 is inserted into and connected to the first inner cavity of the first connection end 1211 of the corresponding first longitudinal beam 121, and the fourth connection end of each third longitudinal beam 321 is inserted into and connected to the second inner cavity of the second connection end 2211 of the corresponding second longitudinal beam 221. Understandably, in other embodiments, the first connection end 1211 of the first longitudinal beam 121 and the second connection end 2211 of the second longitudinal beam 221 can be inserted into the third connection end 3211 and the fourth connection end 3212 of the corresponding third longitudinal beam 321 respectively as required. In the illustrated embodiment, the first longitudinal beam 121, the second longitudinal beam 221, and the third longitudinal beam 321 all are square tube-shaped. That is, the cross sections of the first longitudinal beam 121, the second longitudinal beam 221, and the third longitudinal beam 321 are square. The shape of the first inner cavity of the first connection end 1211 matches the shape of the outer profile of the third insertion end 3211, and the shape of the second connection end 2211 matches the shape of the outer profile of the fourth connection end 3212. The first connection end 1211 and the third connection end 3211 are respectively provided with corresponding first locking holes 1211*a* and third locking holes 3211*a*, and the second connection end 2211 and the fourth connection end 3212 are provided with corresponding second locking holes 2211*a* and the fourth locking holes 3212*a*. After the third/fourth connection ends are inserted into the first/second connection ends, fasteners can be inserted into the aligned first/third locking holes 1211*a*/3211*a*, and second/fourth locking holes 2211*a*/3212*a*, so as to lock/fasten the first/second longitudinal beam 121/221 and the third longitudinal beam 321, avoiding relative movement between the first bed body 10, the second bed body 20 and the third bed body 30 in the longitudinal direction and making the connection more reliable.

In the illustrated embodiment, the longitudinal length of the third support frame 32 (i.e., the longitudinal length of the third longitudinal beam 321) is greater than that of the third platform part 31 (i.e., the longitudinal length of the third longitudinal rod 311), that is, the front and rear ends of the third longitudinal beam 321 in the longitudinal direction extend beyond the third platform part 31. In the lowered state, the rear ends of the first longitudinal beams 121 do not exceed the first platform part 11 in the lowered state and the front end of the second longitudinal beam 221 does not exceed the second platform part 21, so that the longitudinal lengths of the three parts of the first bed body 10, the second bed body 20, and the third bed body 30 are substantially the same after disassembly. Thus, the longitudinal size of the stacked first bed body 10, second bed body 20, and third bed body 30 can be reduced. In addition, since the first actuator 13 and the second actuator 23 are longitudinally staggered to avoid mutual interference during the stacking process after disassembly, the thickness of the stacked three parts can be reduced.

Refer to FIGS. 11 to 14, in the illustrated embodiment, various parts of the platform of the bed can be raised/lifted up to provide a more comfortable posture for the user. The first platform part 11 of the first bed body segment 10 provides support for the back of the user. The second bed body segment 20 provides support for the legs of the user, and the third platform part 31 of the third bed body segment 30 provides support for the buttocks of the user. FIGS. 11 to 14 show a variety of changes of the first platform part 11 and the second platform part 21 in the lowered state and the raised state.

Figure 11:
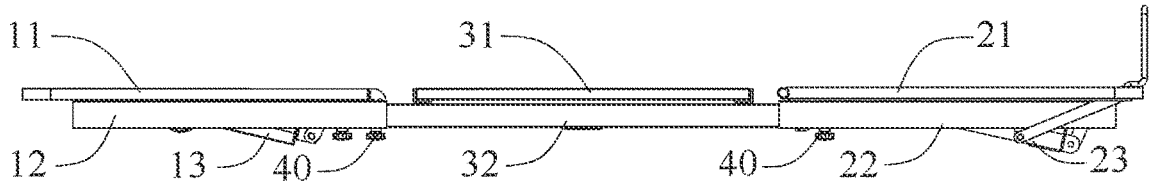
FIGS. 11-14 are schematic views showing various states of the bed in FIG. 1.
Figure 12:
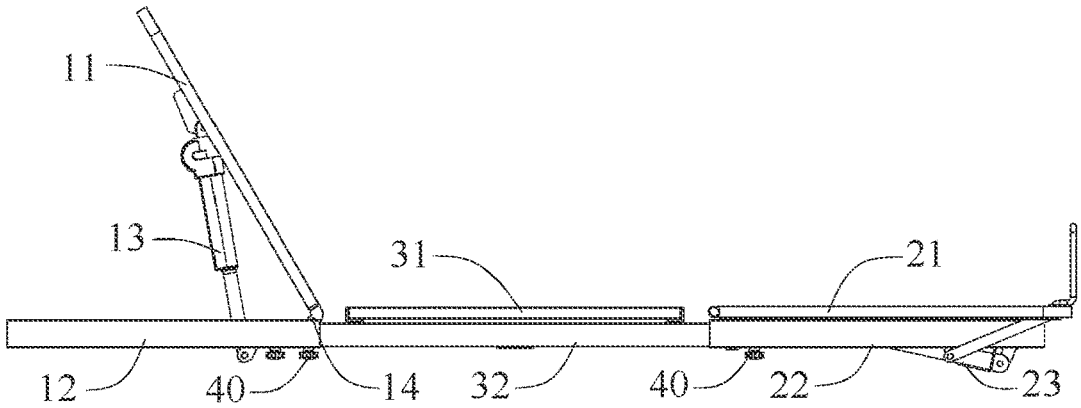

Referring to FIGS. 11 and 12, the first actuator 13 can drive/control the first platform part 11 to rotate about the first hinges 14 relative to the first support frame 12 to thereby lift up the first platform part 11, as shown in FIG. 12. During the lifting process of the first platform part 11, the first actuator 13 provides power to the first platform part 11 so that the first platform part 11 rotates about the first hinges 14 relative to the first support frame 12.

Figure 13:
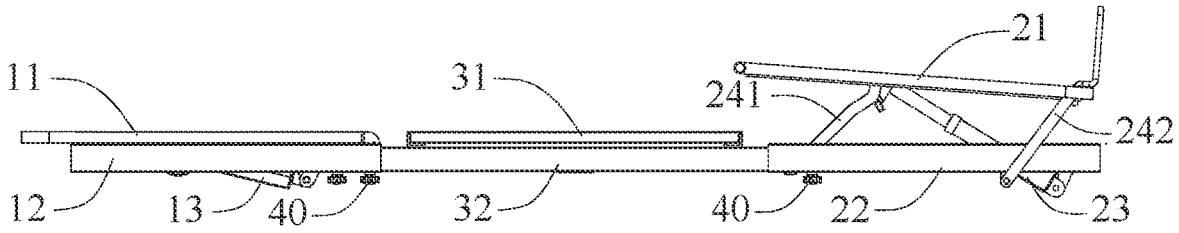

Referring to FIG. 11 and FIG. 13, the second actuator 23 can lift the second platform part 21 through the four-bar linkage, as shown in FIG. 13. During the lifting process of the second platform part 21, the second actuator 23 provides power to the first transverse connection rod 243. The second support frame 22 acts as the base/ground/fixed link of the four-bar linkage. The first connection rods 241 connected to two ends of the first transverse connection rod 243 acts as one side link/rocker of the four-bar linkage, and the second connection rod 242 both ends of which are hinged to the second support frame 22 and the second platform part 21 acts as another side link/rocker of the four-bar linkage. The second platform part 21 acts as a floating link/connecting bar/coupler of the four-bar linkage. Driven by the second actuator 23, the second platform part 21 can be adjusted from a lowered state to a raised state, as shown in FIG. 13.

Figure 14:
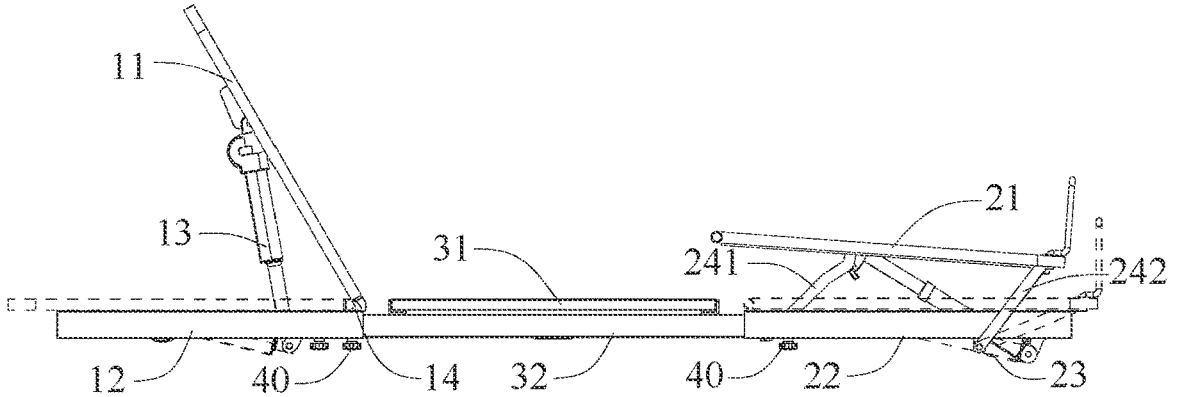

As shown in FIG. 14, the movement of the first platform part 11 and the second platform part 21 are independent of each other, and the third platform part 31 is fixed relative to the third support frame 32.

In summary, the present disclosure provides a multi-segment detachable and combinable bed, which can be detached/divided into multiple bed body segments that are connected in the insertion connection manner together to form a complete bed, e.g., there are three bed body segments (i.e., the first bed body segment, the second bed body segment and the third bed body segment) which may be connected in the insertion connection manner and locked via locking members. Among of them, the platform of the bed is divided into three parts i.e., the first platform part, the second platform part and the third platform part), and the support assembly of the bed is divided into three parts (the first support frame, the third support frame and the second support frame), such that the parts of the platform and the parts of the support assembly can be combined to form the bed body, thereby greatly reducing stacked dimension and package volume to facilitate storage or transportation. Thus, after such a bed of the conventional size is detached, its size is suitable to be directly placed in a family car to provide convenience for customers to purchase, transport and move. The longitudinal beams of the third support frame in the support assembly plays the role of mandrel connection, its two ends are respectively plugged or inserted into the first support frame and the second support frame located at the front end and back end respectively, so that the multiple bed body segments are integrated, which provides a simple and quick combination. The first platform part and the second platform part are of complete/entire/whole structure without needing assembly in use, which not only guarantees the structural strength of the first platform part and the second platform part itself, but also does not require assembly of the platform parts during assembly of the bed, which simplifies the assembly process of the bed. The actuators (electrical components) of the bed are fixed on the support frames corresponding to the backrest portion and the leg support portion respectively, and thus it is unnecessary to perform an installation operation for them, which reduces assembly difficulty for customer.

The concepts described herein can be implemented in other forms without departing from its spirit and characteristics. The specific embodiments as disclosed should be regarded as illustrative rather than restrictive. Therefore, the scope of the present disclosure is determined by the appended claims instead of the foregoing description. Any changes within the literal meaning and equivalent scope of the claims shall fall within the scope of these claims.

What is claimed is:

1. A bed comprising:

a first bed body segment (10) comprising a first platform part (11) and a first support frame (12) installed on a bottom side of the first platform part;

a second bed body segment (20) comprising a second platform part (21) and a second support frame (22) installed on a bottom side of the second platform part; and a third bed body segment (30) connected to the first bed body segment and the second bed body segment respectively, the third bed body segment comprising a third platform part (31) and a third support frame (32) installed on a bottom side of the third platform part;

wherein the first platform part, the second platform part and the third platform part cooperatively form a platform of the bed for bearing loads, the platform defines a longitudinal direction and a transverse direction perpendicular to each other, the first platform part, the third platform part and the second platform part are arranged sequentially in the longitudinal direction, and each of the first support frame and the second support frame is connected with the third support frame via an insertable connection and detachably fastened with the third support frame via fasteners;

the first platform part (11) comprises a first transverse reinforcing member (113) extending in the transverse direction;

the first support frame (12) comprises a first transverse beam (122) extending in the transverse direction;

the first bed body segment (10) comprises a first actuator (13) connected between the first platform part (11) and the first support frame (12) and configured to drive the first platform part (11) to rotate relative to the first support frame (12), the first actuator (13) comprising an end directly connected to the first transverse reinforcing member (113) of the first platform part (11) and an opposite end directly connected to the first transverse beam (122) of the first support frame (12) such that the first bed body segment (10) including the first platform part (11), the first support frame (12) and the first actuator (13) pre-assembled together as an integral unit is connectable to and detachable from the third bed body segment (30); and the second bed body segment (20) comprises a second actuator connected between the second platform part and the second support frame and configured to drive the second platform part to move relative to the second support frame, the second bed body segment (20) including the second platform part (21), the second support frame (22) and the second actuator (23) pre-assembled together as another integral unit is connectable to and detachable from the third bed body segment (30).

2. The bed according to claim 1, wherein longitudinal lengths of the first bed body segment, the second bed body segment and the third bed body segment are substantially equal to one another;

the first actuator (13) is located at a side of and spaced from the third platform part (31) in the longitudinal direction; and the second actuator (23) is located at an opposite side of and spaced from the third platform part (31) in the longitudinal direction.

3. The bed according to claim 1, wherein the first actuator and the second actuator are staggered in the longitudinal direction.

4. The bed according to claim 3, wherein an end of the first platform part close to the third bed body segment is hinged to the first support frame, and a four-bar linkage is connected between the second platform part and the second support frame.

5. The bed according to claim 3, wherein the first platform part (11) comprises a first U-shaped frame (111), a first transverse connection rod (112), a first transverse reinforcing member (113), and first transverse connection ribs (115), the first U-shaped frame (111) comprises two side sections arranged in parallel along the longitudinal direction to form first longitudinal sections, and a middle section arranged in the transverse direction to form a first transverse section connected between the two first longitudinal sections, opposite ends of the first transverse connection rod (112) are connected to ends of the two first longitudinal sections of the first U-shaped frame (111), the first transverse connection rod (112) and the first U-shaped frame (111) together form an outer profile of the first platform part (11);

opposite ends of the first transverse reinforcing member (113) are connected to the two longitudinal sections of the first U-shaped frame (111); and upper hinge tabs (1121) are provided on the first transverse connection rod (112), lower hinge tabs (1223) are provided on the first transverse beam (122), and the upper hinge tabs (1121) and the lower hinge tabs (1223) are rotatably connected together to thereby rotatably connect the first platform to the first support frame.

6. The bed according to claim 5, wherein the first transverse reinforcing member is parallel to the first transverse connection rod and opposite ends of the first transverse reinforcing member are connected to the first longitudinal sections of the first U-shaped frame, the first transverse reinforcing member has a longitudinal size greater than those of the first transverse section of the first U-shaped frame and the first transverse connection rod, the first transverse section of the first U-shaped frame being closer to the first transverse reinforcing member than the first transverse connection rod.

7. The bed according to claim 5, wherein the first platform part (11) further comprises a plurality of parallel first longitudinal rods (114) provided between the longitudinal sections, each of the first longitudinal rods (114) passing through the first transverse reinforcing member (113) and two ends thereof being connected to the first transverse connection rod (112) and the first transverse section of the first U-shaped frame (111).

8. The bed according to claim 5, wherein the second platform part (21) includes a second U-shaped frame (211) and a second transverse connection rod (212), the second U-shaped frame (211) has U-shaped configuration with two second longitudinal sections and a second transverse section connected between the second longitudinal sections, the second transverse connection rod (212) being connected to ends of the second longitudinal sections of the second U-shaped frame (211) away from the second transverse section.

9. The bed according to claim 8, wherein the second platform part further includes a plurality of parallel second longitudinal rods arranged between the second longitudinal sections of the second U-shaped frame, opposite ends of each of the second longitudinal rods being connected to the second transverse connection rod and the second transverse section of the second U-shaped frame respectively.

10. The bed according to claim 2, wherein the first transverse connection ribs (115) are arranged transversely above the first longitudinal rods (114), and two ends of each of the first transverse connection ribs (115) are connected to the first longitudinal sections of the first U-shaped frame (111).

11. The bed according to claim 9, wherein the second platform part further includes a plurality of second transverse connection ribs parallel to the second transverse connection rod, the second transverse connection ribs are arranged transversely above the second longitudinal rod, and two ends of the second transverse connection ribs are connected to the second longitudinal sections of the second U-shaped frame.

12. The bed according to claim 1, wherein the first support frame (12) includes two spaced and parallel first longitudinal beams (121), the second support frame (22) includes two spaced and parallel second longitudinal beams (221), and the third support frame (32) includes two spaced and parallel third longitudinal beams (321), each of the third longitudinal beams (321) being aligned with a corresponding first longitudinal beam (121) and a corresponding second longitudinal beam (221).

13. The bed according to claim 12, wherein each of the first longitudinal beams (121) has a first connection end (1211), each of the second longitudinal beams (221) has a second connection end (2211), each of the third longitudinal beams (321) has a third connection end (3211) and a fourth connection end (3212) respectively extending beyond opposite ends of the third platform part (31), and the third connection end (3211) and the fourth connection end (3212) of each of the third longitudinal beams (321) are respectively connected with the first connection end (1211) of a corresponding one of the first longitudinal beams (121) and the second connection end (2211) of a corresponding one of the second longitudinal beams (221) in an insertable connection.

14. The bed according to claim 12, wherein each of the first longitudinal beams, each of the second longitudinal beams and each of the third longitudinal beams all are square tube-shaped, each of the first longitudinal beams has a first connection end with a first inner cavity, each of the second longitudinal beams has a second connection end with a second inner cavity, each of the third longitudinal beams has a third connection end and a fourth connection end opposite to the third connection end, the first inner cavity of the first connection end is matched with an outer profile of the third connection end in their longitudinal cross-sectional shape, and the second inner cavity of the second connection end is matched with an outer profile of the fourth connection end in their longitudinal cross-sectional shape.

15. The bed according to claim 13, wherein the first and third connection ends are provided with corresponding locking holes, and the second and fourth connection ends are provided with corresponding locking holes therein, and the locking holes are provided to install fasteners to restrict movement of the first bed body segment and the second bed body segment relative to the third bed body segment in the longitudinal direction.

16. The bed according to claim 3, wherein the first platform part is hinged to the first support frame, the second platform part is connected to the second support frame via a transmission mechanism, and the third platform part is fixed to the third support frame.

17. The bed according to claim 16, wherein the transmission mechanism comprises at least one first connection rod (241) and at least one second connection rod (242), and opposite ends of each of the first connection rod (241) and the second connection rod (242) are pivotably connected to the second platform part (22) and the second support frame (21) to cooperatively form a four-bar linkage with the second support frame (21) acting as a fixed link of the four-bar linkage and the second platform part (22) acting as a floating link of the four-bar linkage;

the second support frame (22) comprises a longitudinal beam (221);

the at least one first connection rod (241) is located at an inner side of the longitudinal beam (221) in the traverse direction; and the at least one second connection rod (242) is connected to the longitudinal beam (221) and located at an outer side of the longitudinal beam (221) in the traverse direction.

18. The bed according to claim 17, wherein the second support frame (22) further comprises a transverse beam (222), the second platform part (21) includes a second U-shaped frame (211) comprising two side sections arranged in parallel in the longitudinal direction to form longitudinal sections and a middle section arranged in the transverse direction to form a transverse section connected between the longitudinal sections, the second platform part (21) further includes a plurality of parallel second longitudinal rods (214) arranged between the longitudinal sections of the second U-shaped frame (211), opposite ends of each of the first connection rod (241) are hinged to one of the second longitudinal rods (214) and the transverse beam (222) of the second support frame (22) respectively, and opposite ends of the second connection rod (242) are hinged to the transverse section of the second U-shaped frame (211) and the longitudinal beam (221) of the second support frame respectively.

19. The bed according to claim 17, wherein the at least one first connection rod (241) comprises two parallel first connection rods (241), and a first transverse connection rod (243) and a second transverse connection rod (244) are connected between the two parallel first connection rods (241) to cooperatively form a rectangular configuration.

* * * * *